US008763945B2

(12) United States Patent
Gruzdaitis

(10) Patent No.: US 8,763,945 B2
(45) Date of Patent: Jul. 1, 2014

(54) METHOD AND ARRANGEMENT IN CONNECTION WITH WINDER DRIVE

(75) Inventor: Jukka Gruzdaitis, Vantaa (FI)

(73) Assignee: ABB Oy, Helsinki (FI)

( * ) Notice: Subject to any disclaimer, the term of this patent is extended or adjusted under 35 U.S.C. 154(b) by 219 days.

(21) Appl. No.: 13/298,757

(22) Filed: Nov. 17, 2011

(65) Prior Publication Data

US 2012/0126049 A1 May 24, 2012

(30) Foreign Application Priority Data

Nov. 18, 2010 (FI) ..... 20106220

(51) Int. Cl.
*B65H 23/18* (2006.01)

(52) U.S. Cl.
USPC ..... 242/413; 242/413.1; 242/413.2

(58) Field of Classification Search
USPC ..... 242/413, 413.1–413.5, 541.4, 542
See application file for complete search history.

(56) References Cited

U.S. PATENT DOCUMENTS

| | | | | |
|---|---|---|---|---|
| 3,599,889 | A * | 8/1971 | Pfeiffer | 242/541.6 |
| 4,238,084 | A * | 12/1980 | Kataoka | 242/413.1 |
| 4,496,112 | A | 1/1985 | Olsson et al. | |
| 4,811,915 | A * | 3/1989 | Smith | 242/534.2 |

FOREIGN PATENT DOCUMENTS

| | | | |
|---|---|---|---|
| FI | 80431 | C | 6/1990 |
| FI | 103661 | B | 8/1999 |
| GB | 2 117 935 | A | 10/1983 |
| JP | 04-341451 | A | 11/1992 |
| WO | WO 93/15008 | A1 | 8/1993 |

OTHER PUBLICATIONS

Search Report dated May 21, 2012, issued in corresponding European Patent Application No. 11 18 8176. (2 pages).
Finnish Search Report dated Sep. 23, 2011.

* cited by examiner

*Primary Examiner* — Sang Kim
(74) *Attorney, Agent, or Firm* — Buchanan Ingersoll & Rooney PC

(57) ABSTRACT

A method and arrangement are provided in connection with a continuous material web, which runs from an unwinder to a winder, at least one of which being a center winder. The method includes providing an initial value for density of a material on the center winder, calculating a moment of inertia for a roll of material on the center winder, determining tightness of the material web, producing a correction term for torque calculation based on a material web tightness reference, the material web tightness and the moment of inertia of the roll of material, calculating a torque reference based on the produced correction term and the calculated moment of inertia of the roll of material, and controlling the torque of the center winder based on the torque reference. The method also includes correcting the density value of the material on the center winder based on the produced correction term.

14 Claims, 1 Drawing Sheet

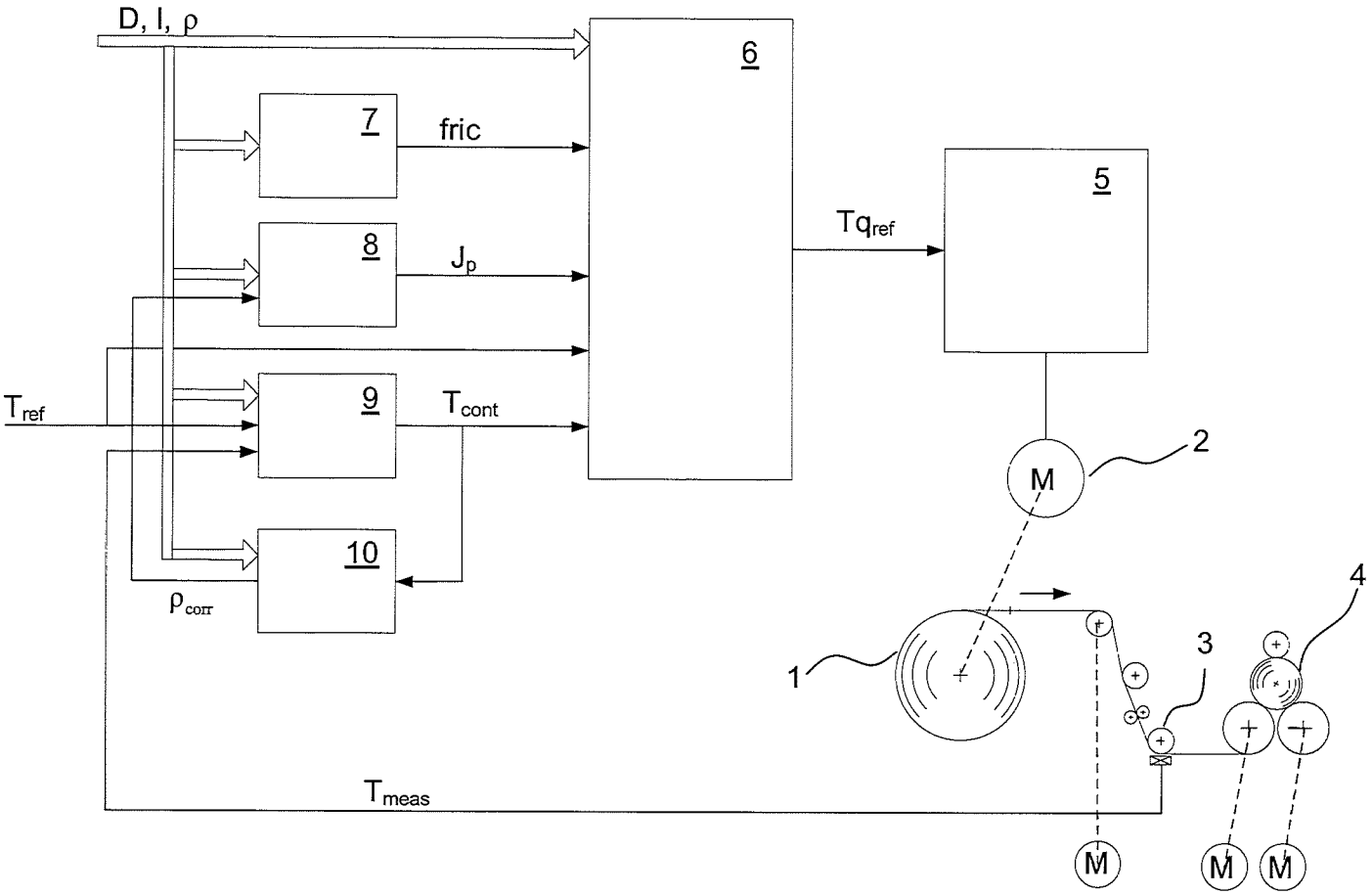
D, l, ρ
fric
7
$J_p$
8
$T_{cont}$
9
10
$\rho_{corr}$
$T_{ref}$
6
$Tq_{ref}$
5
2
M
1
3
4
M
M
M
$T_{meas}$

METHOD AND ARRANGEMENT IN CONNECTION WITH WINDER DRIVE

RELATED APPLICATION

This application claims priority under 35 U.S.C. §119 to Finnish Patent Application No. 20106220 filed in Finland on Nov. 18, 2010, the entire content of which is hereby incorporated by reference in its entirety.

FIELD

The present disclosure generally relates to winders for continuous material webs, and more particularly to controlling the tightness of a material web.

BACKGROUND INFORMATION

In addition to actual paper machines, the paper industry utilizes various post-processing machinery, such as intermediate winders, coaters, different kinds of calenders, slitters, and rewinders. It is a characteristic of such post-processing machinery that at least one of the electric drives thereof is a machine called a center winder wherein a roll of paper is unwound or wound while the diameter of the roll of paper changes during winding. Another characteristic of the unwinders and winders is that the web being wound is controlled by means of tightness control. The tightness control consists of a controller whose current value is measured from the paper web by a sensor installed in a roll, as well as from a feedforward term wherein one part of the term consists of acceleratable moments of inertia.

The unwinders and winders of the post-processing machinery used in the paper industry include accelerating and decelerating large inertia masses, and in order to ensure successful winding it is important to know these inertia masses accurately. When determining the moment of inertia, it is important to know the density of the paper in the roll of paper. It is known to obtain the density of the paper from a data file concerning the roll of paper about to come off the paper machine. In the post-processing machines, density data may be obtained automatically from the paper roll data, or an operator has to manually enter the data into the system of the post-processing machine.

In connection with a grade change on a paper machine, or in other failure situations therein, the density may be erroneous or the data has been entered or measured incorrectly, in which case during post-processing the web tightness shows large variations that, at their worst, may cause the web to break and may thereby cause production losses. Erroneous density data may also cause the quality of post-processed rolls to be lower. A paper roll of poor-quality makes them more difficult to handle for printing machines, for example.

It is known to correct a density value by visually monitoring the process and the tightness control as well as the rolls of paper just off the paper machine. However, correcting the density value in such a manner requires great skill and experience. It is also obvious that such an empirical way of correcting the density value is a particularly unreliable procedure.

SUMMARY

An exemplary embodiment of the present disclosure provides a method in connection with a continuous material web, where the material web runs from an unwinder to a winder, at least one of the winders is a center winder, and the center winder is controlled by an electric drive provided with a torque control. The exemplary method includes providing an initial value for density of a material on the center winder, calculating a moment of inertia for a roll of material on the center winder, and determining tightness of the material web by a mechanical sensor. The exemplary method also includes producing, by a tightness controller, a correction term for torque calculation on the basis of a material web tightness reference, the determined material web tightness and the calculated moment of inertia of the roll of material on the center winder. In addition, the exemplary method includes calculating a torque reference on the basis of the correction term produced by the tightness controller and the calculated moment of inertia of the roll of material on the center winder. The exemplary method also includes controlling the torque of the center winder on the basis of the torque reference, and correcting a density value of the material on the center winder on the basis of the correction term produced by the tightness controller.

An exemplary embodiment of the present disclosure provides an arrangement in connection with a continuous material web, where the material web runs from an unwinder to a winder, at least one of the winders is a center winder, and the center winder is controlled by an electric drive provided with a torque control. The exemplary arrangement includes means for providing an initial value for density of a material on the center winder, means for calculating a moment of inertia of a roll of material on the center winder, and a mechanical tightness sensor configured to determine tightness of the material web. The exemplary arrangement also includes a tightness controller configured to produce a correction term for torque calculation on the basis of a material web tightness reference, the determined material web tightness and the calculated moment of inertia of the roll of material on the center winder. In addition, the exemplary arrangement includes means for calculating a torque reference on the basis of the correction term produced by the tightness controller and the calculated moment of inertia of the roll of material on the center winder. The exemplary arrangement also includes means for controlling the torque of the center winder on the basis of the torque reference, and means for correcting a density value of the material on the center winder on the basis of the correction term produced by the tightness controller.

An exemplary embodiment of the present disclosure provides a non-transitory computer-readable recording medium having a program recorded thereon that causes a processor of a computer processing device to carry out operations in connection with a continuous material web, where the material web runs from an unwinder to a winder, at least one of the winders is a center winder, and the center winder is controlled by an electric drive provided with a torque control. The program causes the processor to carry out operations including: providing an initial value for density of a material on the center winder; calculating a moment of inertia of a roll of material on the center winder; determining tightness of the material web; producing, by a tightness controller, a correction term for torque calculation on the basis of a material web tightness reference, the determined material web tightness and the calculated moment of inertia of the roll of material on the center winder; calculating a torque reference on the basis of the correction term produced by the tightness controller and the calculated moment of inertia of the roll of material on the center winder; controlling the torque of the center winder on the basis of the torque reference; and correcting a density value of the material on the center winder on the basis of the correction term produced by the tightness controller.

BRIEF DESCRIPTION OF THE DRAWINGS

Additional refinements, advantages and features of the present disclosure are described in more detail below with reference to exemplary embodiments illustrated in the drawing, in which:

FIG. 1 is a diagram showing a winding arrangement according to an exemplary embodiment of the present disclosure.

DETAILED DESCRIPTION

Exemplary embodiments of the present disclosure provide a method and an apparatus implementing the method which alleviate the above-mentioned problems associated with known techniques. For instance, exemplary embodiments of the present disclosure provide a method and an apparatus (e.g., an arrangement) in connection with a continuous material web, where the material web runs from an unwinder to an winder. At least one of the unwinder and the winder is a center winder, which is controlled by an electric drive provided with a torque control.

Exemplary embodiments of the present disclosure are based on the idea that during acceleration, a value of the moment of inertia of a center winder for a tightness-controlled material web is corrected by correcting a density value of the material being wound. The density value is known to be incorrect if a tightness controller of the apparatus has to correct torque calculation.

An advantage of the method and arrangement according to the present disclosure is that since the very first acceleration, a density value that has been entered into the system for the material (e.g. paper) being wound is corrected to correspond with the real density. The correct density value is an important piece of information both for the winding process being carried out and for further utilization of the material (e.g., paper). The winding process then yields a uniform end result, for example, a customer roll of paper, having no tightness variations therein. Similarly, should an end user of the customer roll require information on the density of the material, it is now possible to provide such a reliable density value.

FIG. 1 is a diagram showing a tightness-controlled winding arrangement and a related control system according to an exemplary embodiment of the present disclosure. The features of the exemplary method of the present disclosure can be performed by the components illustrated in FIG. 1. The device of FIG. 1 may be, for example, a post-processing apparatus for paper, wherein paper is unwound from a roll 1 by a center winder and wound up onto a roll 4. The post-processing apparatus may be, for example, a slitter which cuts machine rolls coming off a paper machine into customer rolls ordered by a customer. The post-processing apparatus may also be a rewinder, calender or any other processing apparatus for a continuous material web, wherein the material is unwound from one roll and wound onto one or more other rolls. This description mainly discusses the determination of density of material on an unwinder, where the unwinder can be a center winder.

FIG. 1 shows how a frequency converter 5 controls a motor 2 of an unwinder. FIG. 1 also shows three other motors M. These motors are also controlled by frequency converters, although they are not shown herein. A tightness-controlled winder drive operates such that a winder 4 is controlled as speed-controlled while an unwinder is used for controlling the tightness of a material web by controlling a torque of the motor 2 of the unwinder.

In a winding process, the material is accelerated as quickly as possible to a desired running speed and decelerated from the running speed to a halt when a necessary amount of material has been wound. In tightness-controlled winding processes, it is thus important that the unwinder may be used for controlling the tightness of the material web to a desired value by means of the torque produced by a tightness measurement 3 and the frequency converter 5.

In accordance with an exemplary embodiment of the method according to the present disclosure, the density ρ of the material on the unwinder is given an initial value. This magnitude of density is obtained, for example, from the paper machine when the paper grade to be produced is known. The initial value of density may also be obtained on the basis of laboratory measurements.

On the basis of density and other parameters of the material on the unwinder, a moment of inertia of the roll on the unwinder is calculated. In order to calculate the moment of inertia $J_p$ of the roll of material, information on the diameter D of the roll of material, diameter d of a tambour reel, and width I of the roll of material, for example, the material web width, is required. Furthermore, the moment of inertia $J_t$ of the tambour reel is to be added to the moment of inertia.

The moment of inertia of the roll of material is calculated in a manner by employing equation (1):

$$J_p = \frac{\pi}{32}(D^4 - d^4)\rho l \tag{1}$$

whereto the known moment of inertia of the tambour reel is to be added as mentioned above.

The magnitude of the diameter of the roll of material may be measured by an automatic apparatus, and this measurement data may be updated during the winding process. Measuring the width of the material web is also a simple process which yields reliable measurement results.

FIG. 1 shows how necessary parameters, such as density and diameter, are brought to a torque calculation block 6 as initial values. The same parameters are also brought to a block 7 which determines frictions fric present in the apparatus that are also to be taken into account when calculating the torque. Further, in a moment-of-inertia calculation block 8, a moment of inertia is calculated from the initial values by employing equation (1). Of course, the magnitude of this calculated moment of inertia changes as the diameter of the roll being unwound decreases as the winding progresses. In accordance with an exemplary embodiment, the magnitude of the moment of inertia can also become corrected when the procedure is carried out in accordance with the method when the given density deviates from the density established by the method.

A tightness controller 9 of FIG. 1 receives as inputs a tightness reference $T_{ref}$, tightness measurement data $T_{meas}$ from a tightness sensor 3, as well as the aforementioned parameter data. An output $T_{cont}$ of the tightness controller 9 is fed to the block 6 together with outputs of the blocks 7 and 8. In the block 6, the necessary torque is calculated, and a torque reference $Tq_{ref}$ of the output of the block 6 is fed to the frequency converter 5 in order to control the motor 2.

The moment necessary for acceleration or deceleration may be calculated in a known manner as a product of a time derivative of angular speed w and the moment of inertia of the roll being accelerated:

$$T_p = \frac{d\omega}{dt} J_p. \tag{2}$$

Angular speed data is obtained from the control system, for example, by means of web speed and roll diameter. If the calculated initial value given for the moment of inertia is incorrect, the torque reference to be given for the electric drive also becomes incorrect, in which case the web tightness to be measured will not correspond with the tightness reference given as a reference. The tightness controller 9 then corrects the torque calculation and torque reference formation such that a correct web tightness is achieved. According to an exemplary embodiment of the present disclosure, a correction term which is produced by the tightness controller 9 and conveyed to the torque calculation block 6 is further used for correcting the density of the material being unwound. FIG. 1 shows how the output of a tightness controller 9 is connected to a tightness control detector 10 which forms a density correction $\rho_{corr}$ for the moment-of-inertia calculation block 8.

The tightness control detector operates, for example, such that depending on the polarity of the output of the tightness controller, the density value is either increased or decreased. The density value may be changed, for example, such that density is changed in discrete steps having a constant magnitude. In other words, the block 10 increases or decreases the density value to be used in the block 8 for calculating the moment of inertia.

In accordance with an exemplary embodiment, the tightness control detector can also contain logic circuits necessary for changing the density value, because the direction of the change depends on whether the roll on the unwinder is accelerated or decelerated, and also on the direction in which the roll is rolling, since in some unwinders it is possible to choose whether the material is unwound from the top or bottom of the roll. Generally, it may be stated that increasing the density value also increases the value of the calculated moment of inertia and, correspondingly, decreasing the density value decreases the value of the calculated moment of inertia.

Accordingly, the arrangement and method of the present disclosure provide that during a change in speed, the behavior of the output of the tightness controller is monitored and, on the basis of the output, the density value to be used for calculating the moment of inertia is changed. When the output of the tightness controller 9 no longer corrects the torque calculation, the density of the material has become corrected to a correct value. According to an exemplary embodiment, when the output of the tightness controller 9 lies within a given range, the density value is not corrected. In other words, it is unnecessary to correct a small deviation in the density value when the system otherwise operates in a stable manner.

According to an exemplary embodiment, the density value is corrected during a steady change in speed. A steady acceleration or deceleration makes density correction more reliable since the angular speed derivative to be calculated into the torque reference is then substantially constant.

According to an exemplary embodiment of the present disclosure, the corrected density value is shown to the operator either on a display device, or this value is recorded to be used for further utilization of the rolls that are off the paper machine.

When it is assumed that the measurement of the web tightness has been calibrated correctly and that static and dynamic frictions have been determined correctly, exemplary embodiments of the present disclosure also correct other inaccuracies in the calculation of the necessary torque. The density may be provided with set upper and lower limits. When the corrected density value exceeds the upper limit or is below the lower limit, an alarm is activated in the system. The purpose of this alarm is to indicate that the density value has been corrected such that it falls outside limits that are considered realistic, in which case the system itself has a problem to be dealt with.

In a typical case, an error in the initial density value becomes corrected already during the first acceleration, so the customer rolls are of good quality right from the start.

In FIG. 1, features of the present disclosure are described by separate functional blocks. However, it is clear that the separately shown blocks may be included in one processing member which may be, for example, a process computer having an appropriate processing circuitry or a frequency converter provided with necessary calculation capacity for carrying out the operations as described herein. In accordance with an exemplary embodiment, the operative functions of the present disclosure can be implemented by a processor (e.g., general purpose or application specific processor) of a computer, where the processor executes a computer program tangibly recorded on a non-transitory computer-readable recording medium, such as a hard disk drive, optical memory, flash memory, or other non-volatile memory.

The arrangement according to the present disclosure includes means for giving an initial value for the density of a material on an unwinder. These means may include automatic means by which information on the initial density value is transferred from the material production machine to the apparatus implementing the method of the disclosure. The initial value may also be given by manual means by entering the initial density value through entering means.

The arrangement also includes means for calculating a moment of inertia of a material roll on an unwinder. For example, these means can include a processor and necessary memory which can be read and written.

The mechanical tightness sensor of the arrangement, arranged to determine the tightness of a material web, is an ordinary tightness sensor which is placed into contact with the material web, and the material web applies to the sensor a force proportional to the tightness. The type of the tightness sensor may also be other than that of a mechanical sensor.

The arrangement further includes a tightness controller arranged to produce a correction term for torque calculation on the basis of the material web tightness reference, determined material web tightness, and the moment of inertia of the unwinder, and means for calculating a torque reference on the basis of the correction term produced by the tightness controller and the calculated moment of inertia of the material roll on the unwinder. The tightness controller is a controller which receives a tightness reference and feedback from the tightness sensor. On the basis of these outputs, the controller produces a value in its output that has been forwarded to the torque calculation.

The means of the arrangement for controlling the torque of the unwinder on the basis of the torque reference can include a frequency converter which provides the unwinder with a torque in accordance with the torque reference. For example, in connection with a frequency converter, the motor is an alternating current motor. The necessary torque may also be produced by a direct current drive wherein a direct current motor is connected to rotate a winder, and the direct current motor is controlled by an appropriate power feeding control device.

The means of the arrangement for correcting a density value of a material on an unwinder on the basis of a correction term produced by a tightness controller are formed from a processing member which receives the correction term and, on the basis thereof, produces a correction to a previous density-describing value. Such means include memory in which the density value is stored, and means necessary for changing the value stored in the memory in response to the correction term.

The disclosure has been described above in order to determine the density of a material on an unwinder in particular. However, it is clear that the density of a material may be determined in a corresponding manner also in connection with a winder, the winder being a center winder.

It is apparent to one skilled in the art that as technology advances, the basic idea of the disclosure may be implemented in many different ways. The disclosure and its embodiments are thus not restricted to the examples described above but may vary within the scope of the claims.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A method in connection with a continuous material web, the material web running from an unwinder to a winder, at least one of the winders being a center winder, wherein the center winder is controlled by an electric drive provided with a torque control, the method comprising:

providing an initial value for density of a material on the center winder;

calculating a moment of inertia for a roll of material on the center winder;

determining tightness of the material web by a mechanical sensor;

producing, by a tightness controller, a correction term for torque calculation on the basis of a material web tightness reference, the determined material web tightness and the calculated moment of inertia of the roll of material on the center winder;

calculating a torque reference on the basis of the correction term produced by the tightness controller and the calculated moment of inertia of the roll of material on the center winder;

controlling the torque of the center winder on the basis of the torque reference; and correcting a density value of the material on the center winder on the basis of the correction term produced by the tightness controller.

2. A method as claimed in claim 1, wherein the correcting of the density value on the basis of the correction term produced by the tightness controller comprises changing the density value when an absolute value of the correction term produced by the tightness controller exceeds a predetermined limit.

3. A method as claimed in claim 2, comprising:

determining an upper limit and a lower limit for density; and stopping to correct the density when the density reaches the upper limit or the lower limit.

4. A method as claimed in claim 3, comprising:

activating an alarm when the density corrected in a control system of the material web reaches the upper limit or the lower limit.

5. A method as claimed in claim 3, comprising:

determining tolerance limits for the correction term produced by the tightness controller; and correcting the density value when the correction term lies within the tolerance limit.

6. A method as claimed in claim 1, comprising:

determining an upper limit and a lower limit for density; and stopping to correct the density when the density reaches the upper limit or the lower limit.

7. A method as claimed in claim 6, comprising:

activating an alarm when the density corrected in a control system of the material web reaches the upper limit or the lower limit.

8. A method as claimed in claim 1, comprising:

determining tolerance limits for the correction term produced by the tightness controller; and correcting the density value when the correction term lies within the tolerance limit.

9. An arrangement in connection with a continuous material web, the material web running from an unwinder to a winder, at least one of the winders being a center winder, wherein the center winder is controlled by an electric drive provided with a torque control, the arrangement comprising:

means for providing an initial value for density of a material on the center winder;

means for calculating a moment of inertia of a roll of material on the center winder;

a mechanical tightness sensor configured to determine tightness of the material web;

a tightness controller configured to produce a correction term for torque calculation on the basis of a material web tightness reference, the determined material web tightness and the calculated moment of inertia of the roll of material on the center winder;

means for calculating a torque reference on the basis of the correction term produced by the tightness controller and the calculated moment of inertia of the roll of material on the center winder;

means for controlling the torque of the center winder on the basis of the torque reference; and means for correcting a density value of the material on the center winder on the basis of the correction term produced by the tightness controller.

10. A non-transitory computer-readable recording medium having a program recorded thereon that causes a processor of a computer processing device to carry out operations in connection with a continuous material web, the material web running from an unwinder to a winder, at least one of the winders being a center winder, and the center winder being controlled by an electric drive provided with a torque control, the program causing the processor to carry out operations comprising:

providing an initial value for density of a material on the center winder;

calculating a moment of inertia of a roll of material on the center winder;

determining tightness of the material web;

producing, by a tightness controller, a correction term for torque calculation on the basis of a material web tightness reference, the determined material web tightness and the calculated moment of inertia of the roll of material on the center winder;

calculating a torque reference on the basis of the correction term produced by the tightness controller and the calculated moment of inertia of the roll of material on the center winder;

controlling the torque of the center winder on the basis of the torque reference; and correcting a density value of the material on the center winder on the basis of the correction term produced by the tightness controller.

11. A non-transitory computer-readable recording medium as claimed in claim 10, wherein the correcting of the density value on the basis of the correction term produced by the tightness controller comprises changing the density value when an absolute value of the correction term produced by the tightness controller exceeds a predetermined limit.

12. A non-transitory computer-readable recording medium as claimed in claim 10, wherein the program causes the processor to carry out operations comprising:

determining an upper limit and a lower limit for density; and stopping to correct the density when the density reaches the upper limit or the lower limit.

13. A non-transitory computer-readable recording medium as claimed in claim 12, wherein the program causes the processor to carry out operations comprising:

activating an alarm when the density corrected in a control system of the material web reaches the upper limit or the lower limit.

14. A non-transitory computer-readable recording medium as claimed in claim 10, wherein the program causes the processor to carry out operations comprising:

determining tolerance limits for the correction term produced by the tightness controller; and correcting the density value when the correction term lies within the tolerance limit.

* * * * *